United States Patent [19]

Kennon et al.

[11] Patent Number: 4,538,542

[45] Date of Patent: Sep. 3, 1985

[54] SYSTEM FOR SPRAY COATING SUBSTRATES

[75] Inventors: James L. Kennon, Lorain; Richard Sieminski, Elyria; John Sharpless, Oberlin; Donald Scharf, Amherst, all of Ohio

[73] Assignee: Nordson Corporation, Amherst, Ohio

[21] Appl. No.: 631,403

[22] Filed: Jul. 16, 1984

[51] Int. Cl.[3] ..... B05B 13/02

[52] U.S. Cl. ..... 118/302; 118/315; 118/324; 118/326; 118/DIG. 7

[58] Field of Search ..... 55/DIG. 46, 467, 472; 118/326, DIG. 7, 315, 324, 302; 98/115 SB

[56] References Cited

U.S. PATENT DOCUMENTS

| | | | |
|---|---|---|---|
| 1,553,133 | 9/1925 | Bowman et al. . | |
| 2,210,187 | 8/1940 | Ross . | |
| 2,247,963 | 7/1941 | Ransburg et al. . | |
| 2,425,652 | 8/1947 | Starkey . | |
| 2,528,087 | 10/1950 | Schoepe | 118/326 X |
| 3,513,808 | 5/1970 | Mortimer et al. . | |
| 3,902,453 | 9/1976 | Frische . | |
| 3,989,001 | 11/1976 | Brigham et al. | 118/326 X |
| 4,009,301 | 2/1977 | Heckman | 118/324 X |
| 4,099,486 | 7/1978 | Bialorucki et al. . | |

FOREIGN PATENT DOCUMENTS

| | | | |
|---|---|---|---|
| 674799 | 8/1979 | U.S.S.R. | 118/326 |

*Primary Examiner*—Shrive P. Beck

*Attorney, Agent, or Firm*—Wood, Herron & Evans

[57] ABSTRACT

A system for spray coating a substrate such as a plastic container with a gas barrier coating of a polymer dispersion. The system includes a spray coating booth or chamber including spray nozzles dispensing a spray of a coating material onto the surface of a series of containers continuously moving into and out of the coating chamber, an oven for drying the wet coating to remove the water from the coating to form a dried film on the container without distorting the container, and a conveyor for transferring the containers into the coating booth into proximity to the spray nozzles such that on actuation of the nozzles a stream of coating material coats the surface of the bottles with a wet coating layer and, thereafter, to the oven where the wet coating is dried. Means are provided for rotating the bottles during coating, during transport between the spray coating booth and the oven, and while in the oven. The coating booth includes a system for containing and removing both airborne and liquid overspray from the booth, and a dual delivery system for delivering the coating material to the spray nozzles and for reverse flushing the delivery system. The system operates to provide a continuously moving series of containers with a spray coating at production rates suitable for commercial applications.

10 Claims, 6 Drawing Figures

SYSTEM FOR SPRAY COATING SUBSTRATES

BACKGROUND OF THE INVENTION

This invention relates to a system for spray coating substrates, such as preformed plastic containers, with a coating material to form on drying a film on the containers. For example, this invention is applicable to coating polyethylene terephthalate bottles with a copolymer of vinylidene chloride to provide the bottles with a gas barrier coating. More particularly, a coating booth containing conventional airless spray equipment and an oven are employed to provide the surface of a continuously moving series of plastic containers, for example, with a spray coating wherein the flow of coating material to the coating booth is controlled, the airborne overspray contained and captured and the liquid overspray recovered and recycled.

In one particular process to which the present invention is applicable plastic containers for beverages made of polyethylene terephthalate (commonly referred to as "PET" bottles or containers) are coated with a vinylidene chloride (commonly referred to as "PVDC") gas barrier coating. This process is carried out by spray impacting a stream of an aqueous dispersion of film-forming polymer particles onto the substrate surface to form a gel layer having the polymer in the continuous phase of the layer. The process provides initially a wet uniform coating of the substrate which coating is then dried completely coalescing the material into a polymer film.

In this process, it is necessary to continuously deliver aqueous coating material to the spray nozzles for the coating of bottles continuously passing through the spray coating booth, to control the airborne aqueous overspray to prevent its release to the atmosphere while containing polymer particles, and to move the bottles between the spray coating booth and the drying oven for drying the wet coating.

SUMMARY OF THE INVENTION

In one broad aspect of the present invention, a system for carrying out a process of coating substrates, for example, plastic substrates, is provided. The coating system includes a spray coater for receiving a continuously moving line of substrates, e.g., containers to be coated, an oven for receiving the containers after coating for drying of the coating and a transport system for moving the containers into and through the coater and then into and through the drying oven. The speed of the line is controlled for controlling the time the containers are in the spray coating chamber and in the drying oven. The spray coating chamber in a presently preferred form of the invention is a vertical coater having two banks of three sets of spray nozzles vertically disposed on one side wall of the coater. The continuously moving line of containers or bottles to be coated is conveyed downwardly in the coater and in front of the spray nozzles. Conventional airless spray nozzles may be used. One bank of spray nozzles is operated at a time. The bottles to be coated pass in close proximity to the airless spray nozzles through which is passed the wet coating material such that the outside surface of the container is impacted with a stream of the coating material to provide the outside surface of the container with a wet coating layer.

The bottle transport system then carries the coated bottles vertically upward and out of the spray coating booth, to an oven, and vertically downward into the oven. In the oven, the coating is dried by radiant heat to remove the water. Thereafter, as the bottles move through the oven, heating is continued to film-form or completely coalesce the coating on the bottles. Drying time is short enough and the temperature low enough, however, to prevent the distortion of the bottles. The bottles are then conveyed out of the oven and removed from the transport system while bottles to be coated are moved into the system.

The coating system is both efficient and economical by providing a moving line of containers through a continuous coater at coating rates, for example, of 300 bottles per minute.

Generally, the spray coating operation is applied with a 95+% transfer efficiency. The spray coating chamber includes a collection system for collecting the liquid overspray and returning it to be repumped to the spray nozzles. Overspray escaping from the spray chamber is contained and conducted through duct work to first dry it and then through a conventional bag filter to capture the dry film-forming particles in the overspray atmosphere.

The system further includes valves and piping for conducting the liquid material to be coated from a bulk source to the spray nozzles. Preferably, two feed lines are provided containing filters for filtering the coating material upstream of the spray nozzles and such that one filter bank can be shut down for backwashing while the other filter bank is operable.

All in all, the present invention provides a system for coating plastic substrates, e.g., PET bottles with a PVDC barrier coating, to provide coatings having superior physical properties at production rates suitable for commercial applications.

DETAILED DESCRIPTION OF THE INVENTION

Figure 1:
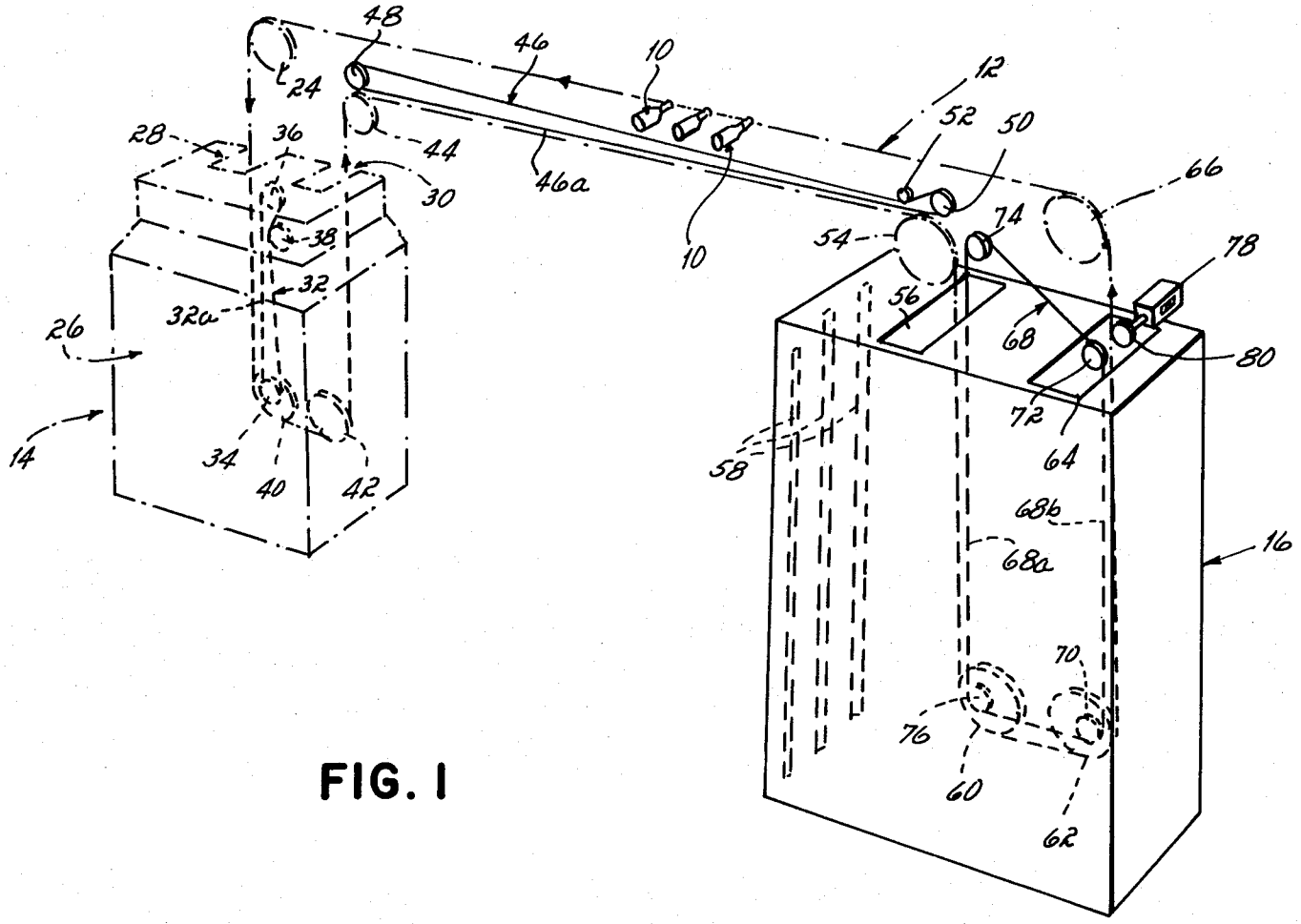
FIG. 1 is a schematic illustration of the system for the coating a continuously moving line of containers according to the present invention.

FIG. 1 shows diagrammatically the system of the present invention for the coating of bottles wherein bottles 10 carried on a conveyor 12 are conveyed into a coater 14 for impact spraying of a liquid dispersion coating thereon, and then conveyed to an oven 16 where the coating layer formed on the containers is dried to remove the water from the coating and to form a thin film, without distortion of the bottles.

Figure 5:
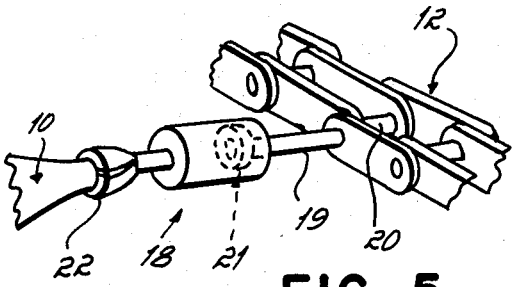
FIG. 5 is a diagrammatic illustration of a chuck and spindle assembly attached to a chain conveyor used in the coating system shown in FIG. 1.

The bottles 10 to be coated, e.g., PET bottles to be coated with PVDC, are mounted on the conveyor 12 in line to form a spaced series of bottles to be conveyed continuously into, through and out of the coater 14 and then the oven 16. Each bottle extends horizontally in a chuck and spindle assembly 18 (FIG. 5) which is mounted to an extension 19 of a chain link pin 20 fixing the chain link of the conveyor 12. The extension 19 has a flanged ball bearing assembly 21 at one end which permits the chuck and spindle assembly 18 to rotate the spindle, in turn, rotating the bottles 10 on the conveyor 12. The chuck and spindle assembly 18 includes a cup 22 which grips the bottle neck to hold it to the assembly and permits removal of the bottles 10 from the assembly 18. The chuck and spindle assemblies 18 are regularly spaced along the chain conveyor 12 and are designed to be spun by a belt engaging the outer surface of the assembly, as will be described in detail. Although only three bottles are shown in FIG. 1 for purposes of illustration, it will be understood that chuck and spindle assemblies are provided along the entire length of the conveyor 12 for the continuous coating of bottles.

The position of the bottles 10, as shown in FIG. 1, shows where the bottles 10 may be loaded and unloaded from the conveyor. After being loaded on the conveyor, the bottles 10 are carried by the chain conveyor 12 in the direction of the arrows in FIG. 1. The bottles 10 pass first around an idler sprocket 24 and then into the spray coater 14. The spray coater 14, which will be described in detail hereinafter, includes a cabinet 26 having a bottle inlet 28 and a bottle outlet 30 at its top. A presently preferred form of inlet 28 and outlet 30 will be described hereinafter. Bottles 10 are conveyed through the inlet 28 into the interior of the cabinet 26 in a vertically downward path such that the bottles pass by a paired bank of impact spray nozzles 29, each bank having three spray nozzle assemblies **29*a*, 29*b* and 29*c* (FIG. 2) which extend through a side wall of the cabinet 14**. Two banks of spray nozzles are provided but only one bank is used at any one time. This permits the coating operation to operate continuously when one bank is shut down for maintenance merely by switching spray coating material to the other bank.

Each of the nozzle assemblies **29*a*, 29*b* and 29*c* includes two airless spray nozzles. Suitable nozzles are airless spray nozzles, Part No. 713201 manufactured by Nordson Corporation of Amherst, Ohio. The nozzle assemblies 29*a*, 29*b* and 29*c* in each bank are laterally spaced one from another in a diagonal line so that each sprays a portion of each bottle 10 as it passes by. With impact spray coating, the bottle-to-nozzle distance preferably is relatively small, e.g., on the order of 2½ inches when spraying a coating material such as a W. R. Grace 820 PVDC emulsion, at a pressure of about 650 psig for approximately 200 msec. To ensure complete coverage of each of the bottles, the bottles are rotated at least two revolutions as they pass by the bank of spray nozzles 29*a*, 29*b* and 29*c***. With a conveyor line speed of around 100 feet per minute, the bottles are rotated during the coating operation at speeds in the range of 200 to 800 rpm. The rate of rotation can be varied depending on the line speed, spray volume from the nozzles, or any other relevant parameter.

Rotation of the bottles within the coater 14 is accomplished by means of a belt 32 mounted on a pair of timing belt sprockets 34 and 36. The timing belt sprocket 36 is driven by a suitable motor (not shown), with the sprocket 34 being an idler sprocket. A tensioner sprocket 38 is provided to maintain adequate tension in the belt 32. With the bottles 10 being conveyed vertically downwardly into the coater 14, the belt 32 moves in a clockwise direction (as shown by the arrows in FIG. 1) such that the portion **32*a* of the belt closest to and parallel with the path of the conveyed bottles 10 moves in a direction opposite to the direction of movement of the bottles. The portion 32*a* of the belt 32 contacts the outer surface of the chuck and spindle assemblies 18** causing them and, as a result, the bottles to rotate in a counterclockwise direction. As stated above, this rotational speed is in the range of 200 to 800 rpm. Rotation of the bottles in a direction opposite the direction of their movement past the spray nozzles causes the bottle surface to rotate into the spray to achieve in cooperation with the nozzle spray pressure and relatively small nozzle-to-bottle spacing the required impacting of the coating material on the bottle to successfully carry out the impact spray process.

After the bottles 10 have been spray coated, they continue downwardly and around a pair of idler sprockets 40 and 42 located in the bottom portion of the conveyor loop within the coater 14. Once the bottles pass around idler sprocket 42, they then move vertically upwardly through the interior of the coater cabinet 26 and out the outlet 30. The bottles on the chain conveyor 12 next pass around an idler sprocket 44 and then are conveyed to the drying oven 16.

Since the bottles 10 exiting from the coater 14 are still wet, a spin is again imparted to the bottles 10 to prevent the coating from sagging as the bottles move between the coater 14 and the oven 16. To this end, a second belt 46 is provided which is carried by two timing belt sprockets 48 and 50, and which spans the distance between the coater 14 and the oven 16. The sprocket 50 is driven by a suitable motor (not shown) and a tension sprocket 52 is provided to maintain proper tension in the belt 46.

A portion **46*a* of the belt 46 runs parallel to the path of the chain conveyor 12 and frictionally engages the outer surface of the chuck and spindle assembly 18** to impart a rotation to the bottles.

The distance between the coater 14 and the oven 16 varies depending on the nature of the coating material. When spray coating an aqueous material, such as PVDC, a distance of 3 to 4 feet may be used. However, when an inflammable solvent-based coating is used, a separation of the coater from the heat source, such as the oven 16, is required to meet applicable codes.

At the oven 16, the bottles 10 on the conveyor 12 next pass around another idler sprocket 54, then vertically downwardly through an inlet opening 56 in the top of the oven 16. Inside the oven 16, the bottles are exposed to heat to cure the coating layer. A radiant heat source is used composed of a plurality of quartz heaters 58 which extend vertically along one interior side wall of the oven 16 adjacent the downward path of the bottles 10 in the oven 16. Although a radiant heat source is illustrated, a convective heat source using electric heaters or some combination of radiant/convective heating could be employed.

The bottles 10 on the conveyor 12 pass into the oven 16 through the inlet 56 and downwardly past the radiant heaters 58. The bottles 10 then travel on the conveyor 12 around an idler sprocket 60 and a drive sprocket 62 in the oven 16, where the conveyor path then turns vertically upwardly to carry the bottles out through an outlet 64. The bottles then pass around a sprocket 66 and back to the loading/unloading point. Drive sprocket 62 propels the entire chain conveyor 12. This sprocket is preferably driven by a variable speed drive motor, such as an electric motor.

The oven 16 is of such a size in relation to the speed of the bottles passing therethrough to provide sufficient heating to the coating on the bottles to dry it throughout its thickness and to form a substantially uniform coating on the bottle surface. The temperature and humidity of the oven can be controlled as desired. A presently preferred environment for drying a PVDC coating on PET containers, for example, is 20–90% relative humidity and a temperature of 170°–175° F. However, the exposure time of the bottles in the oven is short enough to keep the temperature of the containers below their distortion temperature but yet long enough to dry the coating to a substantially tack-free condition. Thus although a single U-shaped path is shown in FIG. 1 for the bottles passing through the oven 16, a larger oven and/or the utilization of a serpentine path may be required for higher line speeds of the conveyor 12. That is, to insure a sufficient dwell time within the oven 16 to effect a proper cure of the coating on the bottles, the oven may be modified so that the bottles 10 are exposed to heat for a sufficient length of time to remove the water from the coating to complete the formation of the desired coating film. The oven time, however, is still short enough to keep the temperature of the containers sufficiently low to avoid distortion of the containers.

As shown in FIG. 1, the bottles 10 within the oven 16 are again spun to expose the bottles evenly to the radiant heaters 58. This is accomplished by another belt 68 which is carried on three timing belt sprockets 70, 72 and 74 and drive sprocket 76. Any suitable variable speed drive motor (not shown can be used to drive the timing belt sprocket 76. Belt 68 engages the outside surface of the chuck and spindle assembly 18, in the same manner as the belts previously described, along a length 68*a* of the belt which runs parallel to the downward path of the bottles to turn the spindles and thus the bottles. In addition, a length 68*b* of belt 68 also runs parallel to the upward path of the conveyor 12 to continue rotation of the bottles as they move upwardly and out of the oven 16.

In practice, it may be desired to locate the position of a given bottle at any given time. To this end, an electronic counter 78 may be used to register the travel of the chain conveyor 12 to indicate the position of a point on the chain conveyor around its circuit. This is accomplished by a small sprocket 80 which engages the chain conveyor 12 to register its travel. Alternatively, the counter can be directly connected to one of the idler sprockets with distance of chain travel correlated to rotation of that idler sprocket.

Figure 2:
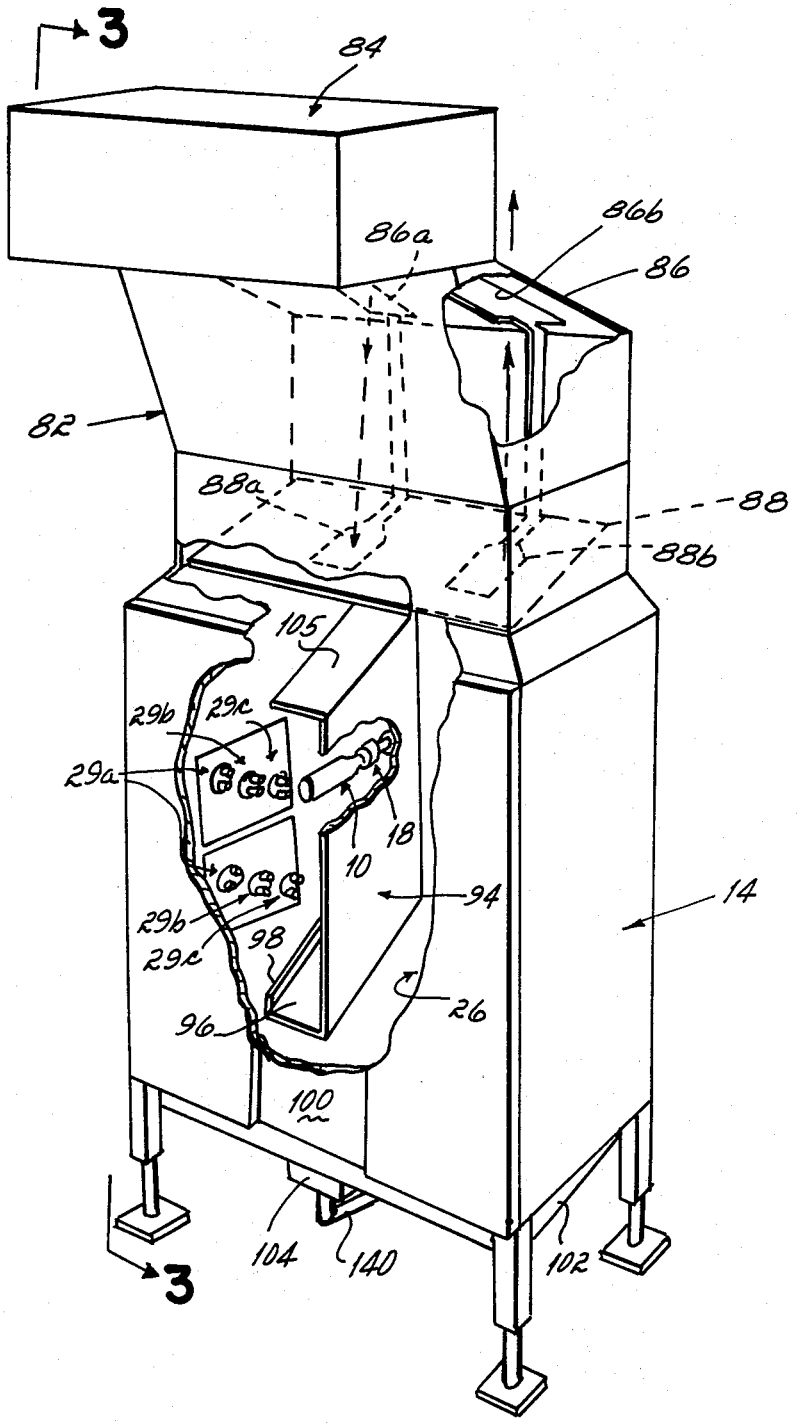
FIG. 2 is a diagrammatic isometric view with parts broken away of a spray chamber used in the coating system shown in FIG. 1.
Figure 3:
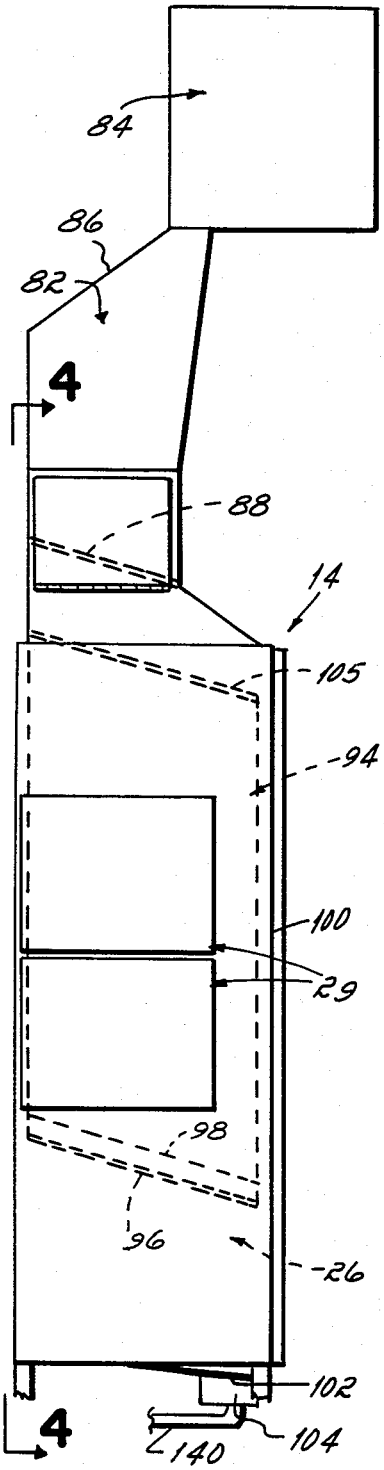
FIG. 3 is a view taken along line 3—3 of FIG. 2.
Figure 4:
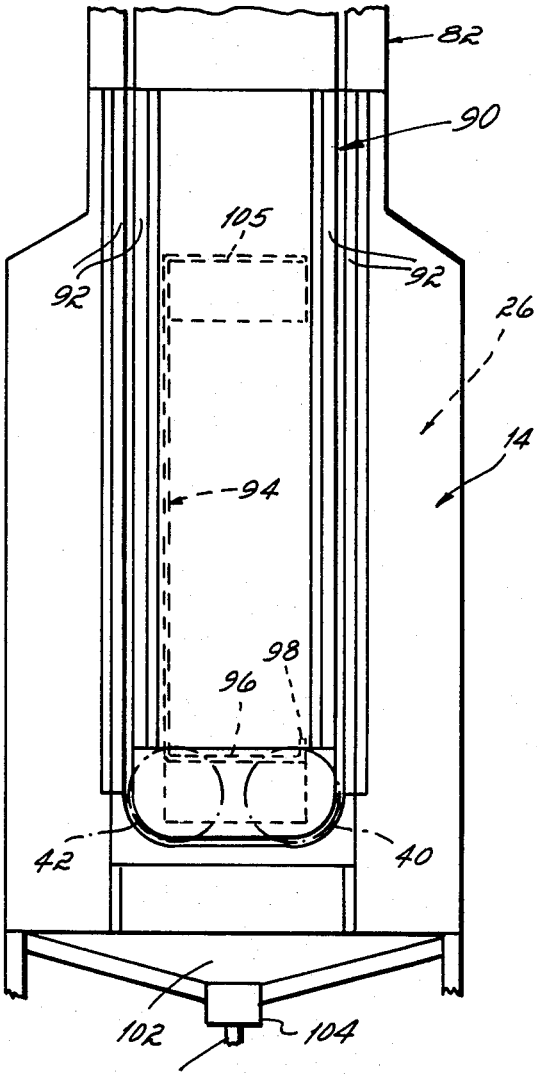
FIG. 4 is a view taken along line 4—4 of FIG. 3.

The coater 14 is shown in more detail in FIGS. 2–4. With reference to those figures, the top of the coater 14 is enclosed with duct work 82 to contain and convey overspray from the coater to a dust collector 84 for collecting oversprayed film-forming particles. To permit the bottles to enter and leave the coater, one wall 86 of the duct 82 is formed of a mask having openings 86*a* and 86*b*, respectively, in the shape of a silhouette of the bottles being coated. A second mask 88 having openings 88*a* and 88*b*, which correspond to bottle inlet 28 and outlet 30 openings in FIG. 1, again in the shape of the silhouette of the bottles being coated is located at the top of the coater interiorly of the duct work 82. Mask 88 closes the top of the coater, except for the openings 88*a* and 88*b*, to contain the overspray within the coater as much as possible while still permitting the bottles to enter the coater through opening 88*a* and exit through opening 88*b*.

Both of the masks 86 and 88 are readily removable to permit quick exchange when the bottles (and the bottle silhouettes) change from one type of bottle to another.

The bottles carried on the conveyor pass through openings 86*a* and 88*a* in turn and into the coater where they are spray coated. After coating, the bottles are conveyed upwardly and through openings 88*b* and 86*b*, in that order, and out of the coater 14. Referring to FIG. 4, which is a back view of the coater 14, the bottle chuck and spindle assemblies 18 extend through a U-shaped conveyor slot 90 in the back of the coater 14. The U-shaped slot has rubber or urethane sealing flaps 92 on opposed side edges along the length of the conveyor slot 90. The flaps 92 slightly overlap to seal the slot 90 against the escape of coating material spray from the cabinet interior. The chuck and spindle assemblies 18 can nevertheless move easily between the flaps 92, with the slot 90 being sealed ahead of and behind each assembly.

As previously described, masks 86 and 88 are used to reduce overspray from escaping from the coater 14. In addition, overspray is further contained within the coater by a channel-shaped overspray baffle 94 inside the cabinet 26 of the coater 14. More specifically, and with reference to FIG. 2, a baffle 94 is located directly opposite the spray nozzle bank 29*a*, 29*b*, 29*c*. The baffle 94 extends vertically along a substantial length of the cabinet interior. Overspray or material deflected from the bottles 10 splashes against this panel. A forwardly sloping baffle portion 96 at the bottom of the panels 94 acts as a gutter to catch the coating material running down the side of the vertical panel 94. The gutter, which has a slight lip 98, collects this overspray and directs it toward the front of the cabinet interior where it can then trickle down the front wall 100 of the cabinet 26 into a forwardly sloping sump 102 to a drain 104 (FIG. 3).

A like baffle portion 105 is located at the upper part of the baffle 94 generally parallel to the bottom portion 96. Baffle portion 105 is likewise forwardly sloped to permit overspray to run off the front of it onto the interior of the front wall 100 of the coater cabinet 26. It will be noted that a slight space of perhaps $\frac{1}{4}$ inch is left between the front of each of the baffle portions 96 and 105 and the inside of the front wall 100 of the cabinet 26 to permit this fluid flow. The lower baffle portion 96 prevents overspray running down the vertical bottle panel 94 from dripping onto the bottles as they travel through the bottom part of the U-shaped conveyor loop in the coater 14 under and around baffle portion 96. The upper baffle portion 105 reduces spray from spattering upwardly out of the cabinet. In this connection, the second mask 88 is also forwardly angled to direct any overspray accumulating on it toward the interior of the front wall 100 of the cabinet 26 where it can trickle down to the sump 102.

Any spray which does escape beyond the baffles 94 and through the second mask 88 is in the form of a relative fine mist as it enters into the ducting 82. From the duct 82 it is captured by the dust collector 84 connected to the top of duct 82. An example of a suitable dust collector is a Torit Model 64 cabinet dust collector which has a plurality of fabric filters to trap dust particles of micron or greater size. An American Air Filter dust collector sold under the name Arrestall, Size No. 400, can also be used.

The dust collector 84 has an internal fan which pulls ambient air through the openings 86*a* and 86*b* of the first mask 86 into the duct 82 and into the dust collector 84. Wet overspray within the duct 82 is caught in this swirling air flow as it passes up through the ducting 82 into the dust collector 84 and is thereby dried to a powder of flour-like consistency. The dried overspray powder is trapped in the dust collector 84 and can then be readily disposed of. A lip (not shown) can be provided along the bottom inner circumference of the ducting 82 to collect any dried particulate powder which may adhere to the interior walls of the duct 82 and then become dislodged and fall downwardly, e.g., by vibration of the duct. Preferably, the dust collector is both vertically and laterally offset from the top of the coater 14 to provide clearance for the bottles carried by the conveyor and sufficient travel distance of the overspray to dry it before reaching the collector. For example, a spacing of the dust collector of about 30 inches vertically from the top of the chamber and offset to provide a diagonal distance from mask 88 to the collector of about 42 inches has been used.

In the present configuration, parts of the coater below the duct 82 which come in contact with the spray coating material are made of 316 stainless steel. The ducting 82 is made of a plastic which is nonreactive with the spray coating material.

Figure 6:
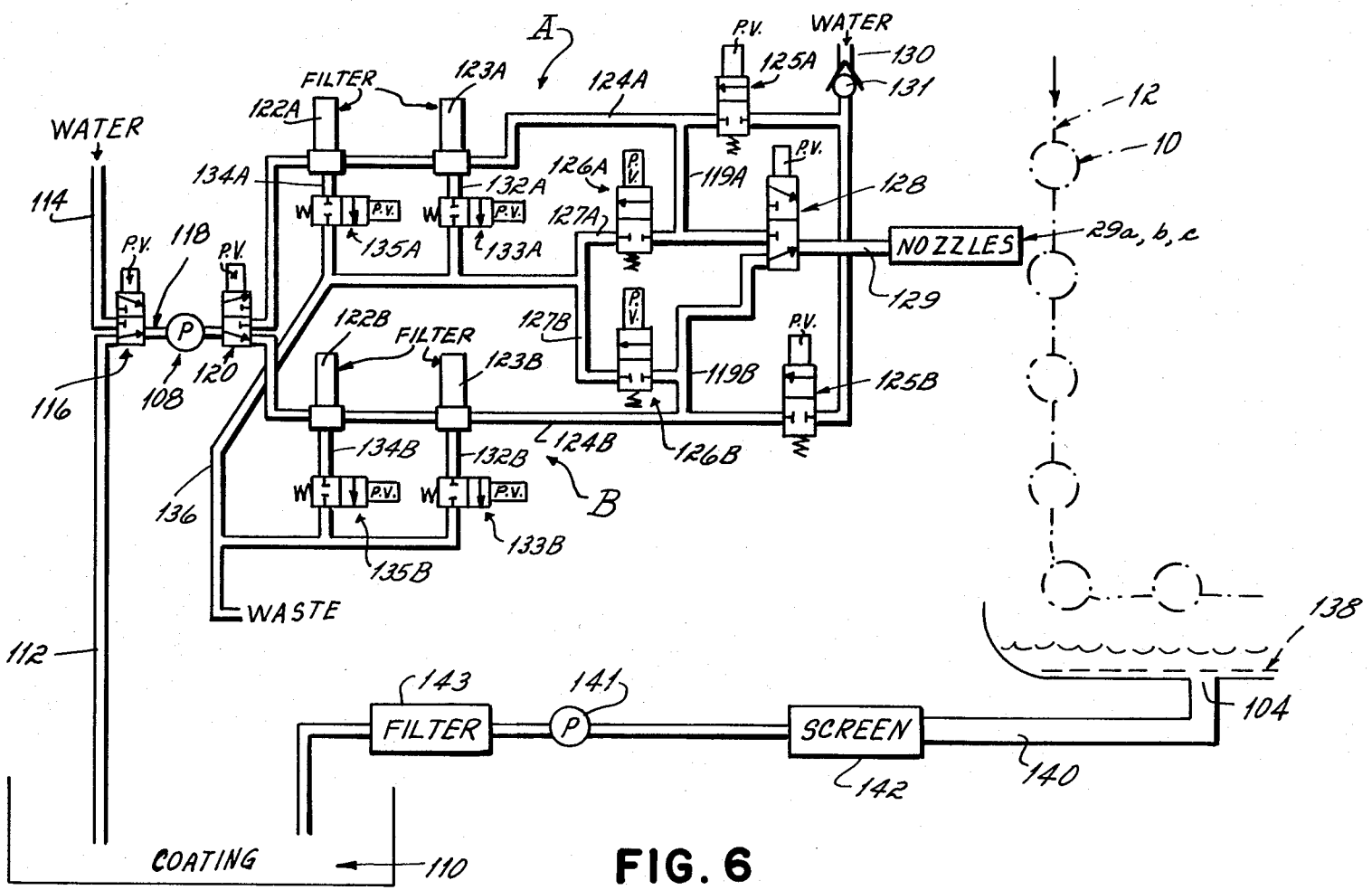
FIG. 6 is a schematic flow diagram for the coating material supply to the spray chamber and the recovery of liquid overspray.

Referring now to FIG. 6, a schematic diagram of the fluid flow system is illustrated. This system provides for alternate flow paths to the pair of banks of spray nozzles 29, as well as for purging the system with water or a cleaning solution. The illustrated flow arrangement provides for the simultaneous flow of coating material to the nozzles through one circuit of the flow path while the other circuit is being back flushed.

A pump 108 draws coating material such as PVDC contained in a supply container or reservoir 110 through a siphon tube 112 into one of two alternate fluid flow circuits indicated by A and B. Pump 108 also draws water for purging the system through water line 114 into either of the two flow circuits A and B. A suitable pump is a Nordson Corporation 711816 pump.

Initial selection between either water or coating material flow is made through the actuation of a three-way valve 116. Both the three-way valve 116 and the pump 108 are located in a connecting line 118 which includes another three-way valve 120 downstream of the pump 108. The three-way valve 120 is actuated to permit fluid flow either into fluid circuit A or fluid circuit B. In FIG. 6, three-way valves 116 and 120 are shown actuated to permit coating material to be pumped from reservoir 110 into fluid circuit B. Following the flow of coating material along its path through circuit B, the coating first passes through a coarse mesh filter 122B and then through a finer mesh filter 123B located in a flow line 124B. These filters 122B and 123B are of a cleanable screen type having a fine mesh wrapped around a core. The filters are designed to be cleaned in situ, as by back flushing.

A two-way valve 125B is shown in the closed position in line 124B. The coating flow therefore passes into a branch line 119B. With a two-way valve 126B closed in line 127B, which connects into branch line 119B, the coating material passes through a three-way valve 128 into nozzle line 129 and from there to the nozzles **29*a*, 29*b* and 29*c* of the nozzle bank. It will be noted that three-way valve 120 and three-way valve 128** are operated in conjunction in the selection of fluid flow through either circuit A or circuit B.

To utilize circuit A instead of circuit B, as when circuit B is being back flushed or serviced, three-way valves 120 and 128 are actuated to permit coating material flow through circuit A in the identical manner as just described in relation to circuit B and to close circuit B. That is, coating material passes through three-way valve 120 into line 124A, then through a coarse filter 122A and then a fine filter 123A where it encounters a closed two-way valve 125A in the line. The material then passes into a branch line 119A where it passes through three-way valve 128, since a two-way valve 126A in line 127A, which connects into line 119A, is closed. The coating material then flows out of circuit A and through nozzle line 129, to the nozzles **29*a*, 29*b* and 29*c*** of the nozzle bank.

The ability to switch coating flow between the two lines A and B permits the coating process to continue while one line is being cleaned, as by back flushing. For purposes of description, back flushing of circuit A will now be described, it being understood that circuit B is cleaned in the identical manner. Circuit A can be back flushed by the introduction of water or some other cleaning fluid at line 130. The water flush passes through a one-way check valve 131 and into line 124A since valve 125B in line 124B is closed. With two-way valve 125A now open to fluid flow, the flush water passes through line 124A to fine filter 123A.

Fine filter 123A is connected to a back flush line 132A, which has a two-way dump valve 133A therein. Coarse filter 122A likewise has a back flush line 134A which likewise has a two-way dump valve 135A. Both lines 132A and 134A connect with a waste line 136 which terminates in a waste fluid receptacle (not shown). With valve 135A closed in the coarse filter back flush line 134A, and with valve 133A open in the fine filter back flush line 132A, back flush water first flushes the fine filter 123A and is then carried to waste line 136. Valve 133A is then closed and valve 135A opened to permit back flush cleaning of the coarse filter 122A. In this way, the filters are cleaned in sequence, and material flowing from one filter is not back flushed into the other. Valves 126A and B in lines 127A and B, respectively, are of course closed to permit this back flush to occur.

After such a back flush of the circuit, water will of course remain in the lines. One method of removing this water would be to simply open the circuit to the flow of coating material to expel the water through the spray nozzles. The coating process would of course have to be shut down while the water was flushed from the lines. However, fluid flow is relatively restricted through the nozzles, as compared to the open flow line 136 to waste. To reduce the amount of water in the circuit ahead of the coating material and thus the changeover time between circuits, an alternate flow path for coating material is provided. To this end, and with regard to circuit A as an example, three-way valve 120 is opened to permit coating to flow into line 124A. The coating material pushes the back flush water in line 124A before it, through line 124A, and into line 119A (two-way valve 125A now being closed). With three-way valve 128 also closed from fluid flow from line 119A valve 126A is opened permitting fluid flow into line 127A and from there into line 136 to waste. Valves 126B, 133A and 135A are of course closed. Water is thus quickly purged from the major portion of circuit A in this manner, with only a small amount remaining to be vented through the nozzles. Circuit B can be treated in a like manner by opening of valve 126B in line 127B.

Water line 114 is provided to purge the entire system, including the spray nozzles. This purge ordinarily occurs at the end of a run, such as when the coating system is being shut down. To this end, three-way valve 116 is actuated to interconnect water flow from line 114 into line 118 while cutting off the flow of coating material. Water can then be pumped through either circuit A or circuit B, as selected at three-way valve 120, and run through the entire circuit and out the nozzles 29*a*, 29*b* and 29*c*.

All piping used in the system is of 316 stainless steel or plastic. Suitable two-way valves for use in the coating material supply system are manufactured by Nordson Corporation, Amherst, Ohio, and are Part No. 713436. Suitable three-way valves are Whitey No. SS-44XF6 valves. As illustrated herein, the valves are all pneumatically operated pilot control valves indicated schematically by the notation "PV" in FIG. 6, and the two-way valves are all spring biased into a normally closed position. Alternatively, the valves could be solenoid operated, or standard ball valves manually operated.

An overspray collection and recirculation system at the bottom of the coater 14 is further shown in FIG. 6. A coarse screen 138 is provided in the bottom of the coater cabinet 26 above the drain 104 which permits overspray to pass into the collecting drain 104 but screens out any large debris which may get into the coater. The sump 102 has a slanted bottom (FIGS. 3 and 4) and terminates in the coating sump drain 104. The drain 104 connects with a return line 140 which opens into the coating reservoir 110. A diaphragm sump pump 141, such as a Wilden Model No. M2 Champ, is located in return line 140 to pump the collected overspray from the coater to the coating reservoir 110. Pump 141 is controlled by a level detector which ensures that the overspray has a controlled residence time in the sump to permit entrapped air to escape from the coating before it is pumped out of the sump. A screen or strainer 142 for catching larger particular matter which might damage the pump is located in line 140 upstream of the pump. A fine filter 143, such as a Filterchem FC-Al-30 type filter body made by Filterchem of Alhambra, Calif., having a 15 micron filter therein is located downstream from the pump.

In operation, the overspray can be collected and returned with the above-described system to achieve greater than 95% material transfer efficiency.

Thus having described the invention, what is claimed is:

1. A system for spray coating a substrate with a liquid coating material containing particles of a film-forming material in a liquid vehicle, said system comprising, in combination, a coater including a coating chamber for receiving the substrate to be coated, spray nozzle means in said chamber for dispensing a spray of said liquid coating material onto said substrate, a chamber for heating said liquid coating material on said substrate to evaporate said liquid vehicle to form a substantially dry film of said material on said substrate, transport means for moving said substrate into said coating chamber, into proximity to said spray nozzle means for coating by said spray nozzle means, out of said coating chamber, and into said chamber for heating said liquid coating material on said substrate, and overspray control means for containing and conveying the airborne overspray from said coating chamber, said overspray control means comprising a particle collector for collecting the particles of film-forming material in said overspray, means for drawing the airborne overspray from said chamber and to said collector, and duct means connecting said particle collector to said coater for containing said overpray as it moves from said chamber to said collector, said particle collector being spaced from said coating chamber a sufficient distance such that said particles of film-forming material are substantially dried on reaching said collector.

2. The system of claim 1 further comprising means for rotating said substrate in said coating chamber and said heating chamber and during transport therebetween.

3. The system of claim 1 wherein said spray nozzle means comprises a hydraulic spray means.

4. The system of claim 1 wherein said coater is a vertical coater, said substrate entering and leaving said coating chamber through the top of the coater, and wherein said particle collector is located above the top of the coater, said duct means including a mask having inlet and outlet openings in the shape of the silhouette of the substrate being coated permitting the substrate to pass therethrough to enter and exit the top of said coating chamber, said means for drawing the airborne overspray from said chamber also drawing ambient air through said openings in said mask to cause drying of said overspray in said duct means between said coating chamber and said particle collector.

5. The system of claim 4 further comprising a mask over the top of the coating chamber having inlet and outlet openings in the shape of the silhouette of the substrate to be coater permitting its entrance to and exit from the coating chamber while limiting escape of the airborne overspray through the top of the coating chamber.

6. The system of claim 1 wherein said heating means comprises radiant heating means for drying the coating on said substrate to a substantially tack-free condition without distortion of said substrate.

7. The system of claim 1 further comprising valve and conduit means for conveying said liquid coating material to said spray nozzle means alternately through either of two available flow paths, said valve and conduit means including a reverse flow system permitting reverse flushing of one flow path while liquid coating material is conveyed to said spray nozzle means through the other flow path.

8. The system of claim 7 wherein said valve and conduit means includes a water supply line for forward flushing of said flow paths, said valve and conduit means being operative to forward flush said flow paths with water to a waste outlet line with only a minor portion of the water being vented through said spray nozzle means.

9. The system of claim 7 further comprising conduit means for conveying the liquid overspray from the bottom of said coater for recycling to said spray nozzle means.

10. A system for spray coating of containers with a liquid coating material comprising containing particles of a film-forming material in a liquid vehicle, said system comprising, in combination, an enclosed coater including a coating chamber for continuously receiving a series of containers to be coated, said containers moving vertically downward into said coating chamber to be coated and vertically upwardly out of the coating chamber after spray coating, spray nozzle means in a vertical wall of said chamber for dispensing a stream of said liquid coating material, means for locating said containers to be coated in proximity to said spray nozzle means such that on actuation of said spray nozzle means said stream of liquid coating material impacts on the surface of the containers to be coated, oven means spaced from said continuous coater for receiving said containers having the liquid coating material thereon, said oven means including heating means for heating the coating material on the substrate to remove said liquid vehicle to form a substantially tack-free film of said material on said substrate, conveyor means for continuously transporting said containers into said coater, into proximity to said spray nozzle means for impact spray coating of said containers, vertically upwardly out of said continuous coater, to said oven means, and into and out of said oven means, the length of travel of said coated containers through said oven means being such in relation to the speed of said conveyor means that said liquid coating on said containers is dried to a substantially tack-free condition without distortion of the containers, means for rotating said containers as they pass into proximity of said spray nozzle means, as they travel from said continuous coater to said oven means, and while in said oven means, overspray control means for containing and conveying the airborne overspray from said coating chamber, said overspray control means comprising a particle collector for collecting the particles of film-forming material in the airborne overspray, means for drawing the airborne overspray from said chamber to said collector and duct means connecting said particle collector to said coating chamber for containing said overspray as it moves from said chamber to said collector, said particle collector being mounted above the top of the coater, said duct means including a mask having inlet and outlet openings in the shape of the silhouette of the containers being coated permitting the containers to pass therethrough and into said duct means and then to enter and exit the top of the coating chamber, said means for drawing the airborne overspray from said chamber to said particle collector being operative to draw ambient air through said openings in said mask to cause drying of said overspray in said duct means between said coating chamber and said particle collector, said particle collector being removed from said coating chamber a sufficient distance such that said particles of film-forming material are substantially dry on reaching said collector, a second mask over the top of the coating chamber having inlet and outlet openings in the shape of the silhouette of the containers to be coated permitting their entrance to and exit from the coating chamber while limiting escape of the airborne overspray through the top of the chamber, and liquid spray material supply means comprising valves and conduits defining two alternate flow paths from a source of liquid coating material to said spray nozzle means, said valves and conduits being operative to alternate flow of liquid coating material through either flow path while permitting reverse flushing of the other flow path.

* * * * *